United States Patent [19]

Maringer

[11] Patent Number: 4,484,614

[45] Date of Patent: Nov. 27, 1984

[54] METHOD OF AND APPARATUS FOR STRIP CASTING

[75] Inventor: Robert E. Maringer, Worthington, Ohio

[73] Assignee: Allegheny Ludlum Steel Corporation, Pittsburgh, Pa.

[21] Appl. No.: 395,177

[22] Filed: Jul. 6, 1982

Related U.S. Application Data

[63] Continuation of Ser. No. 148,440, May 9, 1980, abandoned.

[51] Int. Cl.[3] ..... B22D 11/06; B22D 11/10

[52] U.S. Cl. ..... 164/463; 164/423; 164/429; 164/437; 164/479; 164/488; 222/594

[58] Field of Search ..... 164/463, 488, 423, 427, 164/429, 437, 479, 133, 335, 418; 222/561, 80, 594; 264/169

[56] References Cited

U.S. PATENT DOCUMENTS

| | | | |
|---|---|---|---|
| 905,758 | 12/1908 | Strange et al. | 164/429 |
| 999,904 | 5/1911 | Strange | 164/429 |
| 2,308,034 | 1/1943 | Van Derhoef | 222/80 X |
| 2,825,108 | 3/1958 | Pond | 164/423 X |
| 2,891,291 | 6/1959 | Schnacke | 164/437 X |
| 3,112,528 | 12/1963 | Czerkas | 264/169 |
| 3,297,436 | 1/1967 | Dungz | 164/479 |
| 3,522,836 | 8/1970 | King | 164/479 |
| 3,605,863 | 9/1971 | King | 164/4.1 X |
| 3,838,185 | 9/1974 | Maringer et al. | 164/463 X |
| 3,896,203 | 7/1975 | Maringer et al. | 164/463 X |
| 4,077,462 | 3/1978 | Bedell et al. | 164/429 |
| 4,142,571 | 3/1979 | Narasimhan | 164/437 X |

*Primary Examiner*—Nicholas P. Godici
*Assistant Examiner*—J. Reed Batten, Jr.
*Attorney, Agent, or Firm*—Patrick J. Viccaro

[57] ABSTRACT

An apparatus for continuously casting strip material onto a casting surface includes a tundish for receiving and holding molten metal having a nozzle therein. The nozzle comprises an orifice passage defined between a first inside surface and a second inside surface, wherein at least a portion of at least one inside surface comprises an insert disposed against the tundish. A nozzle gap of at least 0.010 inch is maintained, an outer portion of the insert is able to be disposed to within 0.120 inch of the casting surface, and at least a portion of the outside surface of the tundish at the orifice of the nozzle is able to be disposed to within at least about 0.020 inch of the casting surface.

39 Claims, 14 Drawing Figures

METHOD OF AND APPARATUS FOR STRIP CASTING

This is a continuation of application Ser. No. 148,440, filed May 9, 1980, now abandoned.

BRIEF SUMMARY OF THE INVENTION

Incorporated herein, by reference, is the subject matter of co-filed U.S. patent applications entitled "Strip Casting Apparatus", Ser. No. 148,421, now abandoned; "Method and Apparatus for Strip Casting", Ser. No. 148,359; "Method of Repetitiously Marking Continuously Cast Metallic Strip Material", Ser. No. 148,448, all of which were filed May 9, 1980 and are assigned to the assignee of the present application; and "Strip Casting Nozzle", Ser. No. 148,441, now abandoned, filed May 9, 1980.

The present invention relates to the casting of strip material at high quench rates and at high production rates. More particularly, the present invention is directed to a new and improved apparatus for rapidly casting thin metallic strip material.

The apparent advantages and economic significance of producing thin metallic strip material by a casting process, as compared to the conventional rolling or reducing operations, are numerous. The fact that strip casting may be performed at such high quench rates to produce amorphous material is even more meaningful. However, it is equally apparent that there are a multitude of strip casting parameters which must be controlled or monitored to assure that the cast strip is of acceptable quality and of uniform composition and structure. For these reasons, those skilled in the art appreciate that the development of a commercially successful strip casting apparatus is difficult.

The general concept of casting thin metallic materials such as sheet, foil, strip and ribbon was disclosed in the early 1900's. For example, U.S. Pat. Nos. 905,758 and 993,904 teach processes wherein molten material flows onto a moving cool surface and the material is drawn and hardened thereon into a continuous thin strip. These references teach that molten metal may be poured onto the smooth peripheral surface of a rotating liquid-cooled copper drum or disc to form strip materials. Despite early disclosure of such concept, there is no evidence of commercial success of strip casting during the early part of the 20th century.

Recently, in U.S. Pat. Nos. 3,522,836 and 3,605,863 a method for manufacturing a continuous product, such as metallic wire or strip from molten metal has been disclosed. These references teach that a convex meniscus of molten material should project from a nozzle. A heat extracting surface, such as a water-cooled drum, is moved in a path substantially parallel to the outlet orifice and into contact with the meniscus of molten metal to continuously draw material from the meniscus to form a uniform continuous product. The above-described method is commonly called the "melt drag" process as the heat extracting surface moving past the meniscus of molten metal at the nozzle orifice actually has an effect on the rate of molten metal flow, or drag, through the nozzle.

Even more recent strip casting developments focus on relatively narrow refinements in the metallic strip casting art. For example, U.S. Pat. No. 4,142,571 is particularly directed to a slot construction in a metal strip casting nozzle having stringent dimensional requirements. Also, U.S. Pat. No. 4,077,462 pertains to the provision of a specific construction for a stationary housing above the peripheral surface of a chill roll used for strip casting.

There are a number of other rapid quenching techniques known in the art. For example, melt spinning processes of producing metallic filament by cooling a fine molten stream either in free flight or against a chill block have been practiced. Also known are melt extraction techniques, such as crucible melt extraction disclosed in U.S. Pat. No. 3,838,185 and pendant drop melt extraction techniques taught in U.S. Pat. No. 3,896,203. It has been found difficult to produce uniform sheet or strip by such alternative techniques of rapid casting. There are many factors, such as auxiliary surface cooling, surface coatings and the like which appear to affect product thickness and quality of rapidly cast strip material.

Despite the relatively long history of the art of strip casting, and the recent developments in this area, strip casting is not a widely accepted and commercially significant operation at the present time. It appears that various improvements, modifications and innovations are required in the art to effectuate a significant commercial impact in the art of strip casting. In particular, proper relationships among such variables as molten metal tundish construction, nozzle orifice size and dimensions, spacing from a casting surface, speed at which such surface is moved, quench rates, metal temperature and feed rates, and the like may require more accurate identification in order to accomplish the uniformity and consistency required for successful, commercial production of cast strip. In particular, certain nozzle and slot structures and their dimensional relationship to the casting surface onto which strip material is cast, have been found to be inadequate to yield uniform strip casting results.

Since it is apparent that dimensional relationships between the casting nozzle and the casting surface are critical, prior strip casting apparatus have been constructed with the nozzle forming an integral part of a molten metal holding tundish or with the nozzle integrally mounted therein. Thus, when it becomes necessary to move, align or change a nozzle, the tundish is also affected. Therefore, the requirement of maintaining rigid dimensional relationships has prevented flexibility in design and operation of the strip casting apparatus.

Accordingly, a new and improved apparatus for casting relatively wide, thin strip material is desired which overcomes the disadvantages of the prior art structures. Such desired apparatus should be more efficient, more effective and more flexible than the structures disclosed in the prior art, and should lead to uniformity and consistency in strip casting.

The present invention may be summarized as providing a new and improved apparatus for continuously casting metallic strip material onto a casting surface. Such apparatus comprises a tundish for receiving and holding molten metal having a nozzle therein. The nozzle comprises an orifice passage defined between a first inside surface and a second inside surface, wherein at least one inside surface comprises an insert disposed against the tundish. A nozzle gap of at least 0.010 inch is maintained, an outer portion of the insert is able to be disposed to within 0.120 inch of the casting surface, and at least a portion of the outside surface of the tundish at the orifice of the nozzle is able to be disposed to within at least about 0.020 inch of the casting surface.

Amoung the advantages of the present invention is the provision of a strip casting apparatus which is capable of continuously casting metallic strip material of substantially uniform dimension and substantially uniform quality throughout its length.

Another advantage of the present invention is the provision of a strip casting apparatus having a nozzle construction which promotes rapid casting of metals with a minimum of metal turbulence during casting.

An objective of the present invention is to provide a strip casting apparatus capable of reproducing successful strip casting operations.

Another objective of this invention is to provide a strip casting apparatus which can effectuate sufficiently rapid quenching of the produced strip to result in the production of amorphous strip. However, it should be understood that the production of continuously cast crystalline material is also comprehended by the present invention.

A further objective of this invention is to identify certain design and dimensional requirements, particularly with regard to nozzle structure, which permit continuous and repetitious rapid casting of metallic strip material of uniform dimension and uniform quality.

Another objective of the present invention is to utilize at least one, separate insert to form a part of the nozzle. Such insert may be moved, aligned or changed without substantially effecting the remainder of the apparatus. Such insert may be generally unobstructed which facilitates the physical adjustment thereof, permits direct heating thereof and allows virtually unrestricted visual observation of the casting operation.

These and other objectives and advantages will be more fully understood and appreciated with reference to the following detailed description and the accompanying drawings.

DETAILED DESCRIPTION

Figure 1:
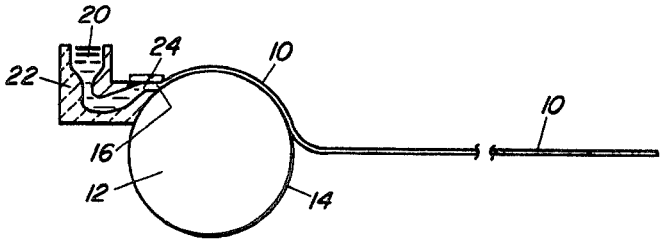
FIG. 1 is a side elevation view, partially in cross-section, illustrating a typical apparatus used for continuously casting strip material.

Referring particularly to the drawings, FIG. 1 generally illustrates an apparatus for casting metallic strip material 10 in accordance with the present invention. This apparatus includes an element 12 upon which the strip 10 is cast. In a preferred embodiment a continuous strip 10 is cast onto a smooth, outer peripheral surface 14 of a circular drum or wheel as shown in FIG. 1. It should be understood that configurations other than circular may be employed. For example, a wheel with a smooth, frustoconical outer peripheral surface (not shown) may be employed. Also, a belt capable of rotating through a generally ovular path may also be employed as the casting element. Regardless of the configuration employed, the cooled casting surface should be at least as wide as the strip to be cast.

In a preferred embodiment, the casting element 12 comprises a water cooled, precipitation hardened copper alloy wheel containing about 90% copper. Copper and copper alloys are chosen for their high thermal conductivity and wear resistance, however, steel, brass, aluminum, aluminum alloys or other materials may be utilized alone, or multipiece wheels having sleeves of molybdenum or other material may also be employed. Likewise, cooling may be accomplished with the use of a medium other than water. Water is chosen for its low cost and its ready availability.

In the operation of the strip casting apparatus of the present invention, the surface 14 of the casting wheel 12 must be able to absorb the heat generated by contact with molten metal at the initial casting point 16, and such heat must diffuse substantially into the copper wheel during each rotation of the wheel. Heat diffusion, cooling, may be accomplished by delivering a sufficient quantity of water through internal passageways located near the periphery of the casting wheel 12. Alternatively, the cooling medium may be delivered to the underside of the casting surface. Understandably, refrigeration techniques and the like may be employed to accelerate or decelerate cooling rates, and/or to effectuate wheel expansion or contraction during strp casting.

Whether a drum, wheel or belt is employed for casting, the casting surface should be generally smooth and symmetrical to maximize uniformity in strip casting. For example, in certain strip casting operations wherein it is desired to cast uniform gage strip, the distance between the outer peripheral casting surface 14 and the surfaces defining the orifice of the nozzle which is feeding the molten material onto the casting surface should not substantially deviate from a desired or set distance. This distance shall hereinafter be called standoff distance or gap. It is understandable that the gap must be substantially maintained throughout the casting operation when it is the intention of the operator to cast uniform strip material.

It should also be understood that if the casting element is a drum or a wheel, the element should be carefully constructed so as not to be out-of-round during operation to insure uniformity in strip casting. Along these lines, it has been found that a drum or wheel which is out-of-round by about 0.020 inch, or more, may have a magnitude of dimensional instability which, unless corrected or compensated during operation, may be unacceptable for certain strip casting operations. It has been found that acceptable dimensional symmetry, as well as the elimination of problems associated with weld porosity may be more readily accomplished by fabricating a wheel or drum from a single, integral slab of cold rolled or forged copper. However, as mentioned above alternative materials may be employed.

The molten material 20 to be cast in the apparatus described herein is preferably retained in a crucible 22, or tundish, which is provided with a pouring orifice 24 or nozzle. The nozzle is typically, though not necessarily, located at a lower portion of the tundish 22 as shown in FIG. 1.

The tundish 22 is constructed for receiving and holding molten metal therein. it will be appreciated that appropriate materials must be utilized for the tundish 22 to withstand the molten metal conditions, and where the tundish 22 is not a monolithic structure, the joints and seams between separate pieces of the tundish must be assembled to prevent molten metal leakage during sustained operation.

Figure 2:
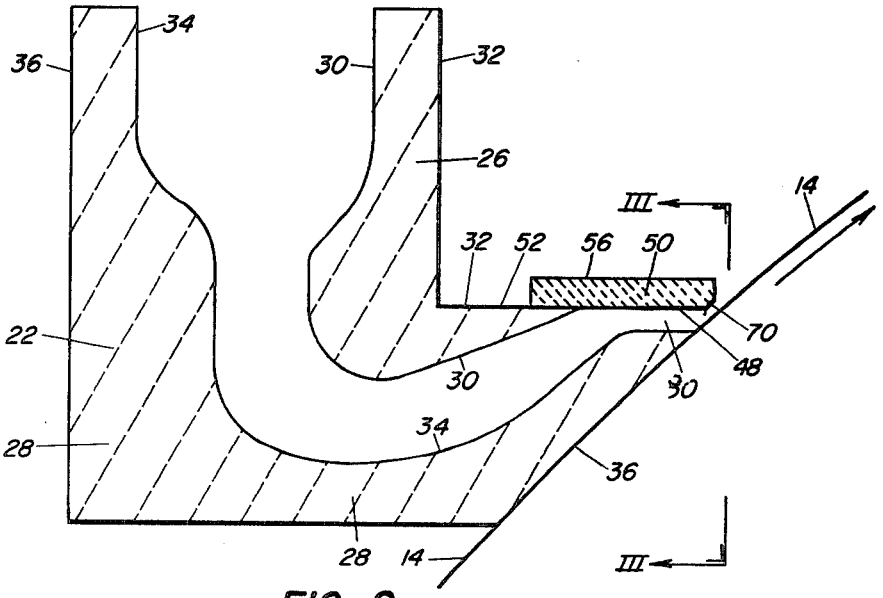
FIG. 2 is a cross-sectional view of a tundish and nozzle of the present invention.

The tundish 22 has a front wall 26 and a rear 28, with respect to the casting direction, which casting direction is indicated by the arrow adjacent the casting surface 14 in FIG. 2. The front wall 26 has an inside surface 30 and an outside surface 32 with respect to the molten metal holding portion of the tundish 22. Likewise, the rear wall 28 has an inside surface 34 and an outside surface 36 with respect to the molten metal holding portion of the tundish 22. The inside surfaces 30 and 34 extend toward the nozzle area of the tundish 22. It should be understood that the molten metal holding portion of the tundish 22, which is formed between the inside surfaces 30 and 34, may take a variety of forms or shapes. However, it is preferable that the upper portion of the tundish 22 have a significantly larger cross-sectional volume than that of the nozzle area of the tundish 22 in order that the molten metal head height, above the nozzle, is substantially unaffected by minor variations in molten metal volume in the tundish 22. Such structure contributes to the maintenance of a substantially constant metallostatic head pressure at the nozzle, even with minor variations in metal volume in the tundish 22.

It is also preferable that the inside surfaces 30 and 34 converge toward one another in the direction of the nozzle, and that such surfaces 30 and 34 be radiused, rounded or generally curvilinear at locations of turns or bends in the tundish 22 to minimize metal turbulence therein during the casting operation.

Figure 3:
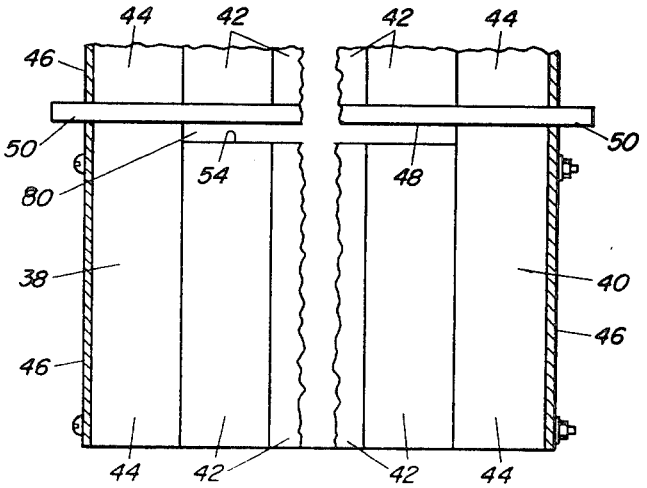
FIG. 3 is a front elevation view through III—III of the tundish and nozzle shown in FIG. 2.

The molten metal holding area, formed between the inside surfaces 30 and 34, should be enclosed with sidewalls 38 and 40, as indicated in FIG. 3. It is noted that no fixed width dimension is shown in FIG. 3. It has been found that a tundish and nozzle of the present invention may be constructed by first cutting or carving refractory boards, such as insulating boards made from fiberized kaolin, into the desired tundish shape, such as that shown in FIG. 2. Any number of these boards 42 may be stacked upon one another to obtain the desired tundish and nozzle width. There is not expected to be a restriction on the maximum width of the tundish and nozzle of the present invention, and widths in excess of thirty six inches are comprehended by the present invention. After the requisite number of boards are stacked the inside surfaces 30 and 34 are formed by the stack may be sanded or otherwise finished to provide generally smooth inside surfaces 30 and 34 across the width of the stacked elements forming the tundish 22. It should also be understood that single piece materials may be used to construct the tundish in which case stacking would not be necessary. After the carved boards 42 are stacked, the stack may be disposed between uncarved boards 44, which may serve as the sidewalls 38 and 40 for the tundish 22.

To hold the stacked boards, including the sidewalls 38 and 40 in position, it has been found convenient to dispose a metal plate 46 against the outside surface of each sidewall and to bolt the plates together at a suitable number of locations about the tundish, thereby tightly compacting the tundish assembly. With such assembly, a minor amount of molten metal may tend to flow into the seams between the boards, but the compaction of the assembly and the high insulative value of the boards causes the metal to freeze, and thereby arrest the flow before it adversely affects the tundish or the strip casting operation. It should be understood that the tundish 22 of the present invention may be assembled with refractory cements, or the like, or may be constructed of a monolothic structure which does not require assembly.

As discussed above, a nozzle 24 is located in the tundish 22, preferably in a lower portion thereof. The nozzle 24 comprises an orifice passage 80 defined between the first inside surface 34 of the rear wall 28 of the tundish 22 and the second inside surface 48 of an insert 50. A portion of the inside surface 48 of an insert 50, which is FIG. 2, is disposed against a portion of a ridge 52 formed by the outside surface 32 of the front wall 26 of the tundish 22. As shown in FIG. 3, the insert 50 completely encloses the orifice passage, or slot 80 such that the end portions of the inside surface 48 of the insert 50 are disposed against ridges on the sidewalls 38 and 40 of the tundish 22. Such disposition may be necessary to maintain the stability of the insert 50. In a preferred embodiment, a portion of the inside surface 48 of the insert 50 extends beyond the front wall 26 of the tundish 22 in the direction of the casting surface 14. It should be appreciated that the extent of the insert 50 may be flush with the extent of the front wall 32 of the tundish as measured in a direction toward the casting surface. Preferably, the extent of the insert, as indicated by numeral 70 in FIG. 2, is maintained at a distance of at least 0.010 inch from the inside surface 34 of the rear wall 28, at the orifice passage 80.

Figure 4:
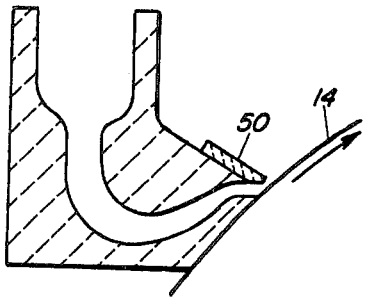
FIG. 4 is a cross-sectional view of an alternative tundish and nozzle of the present invention.
Figure 5:
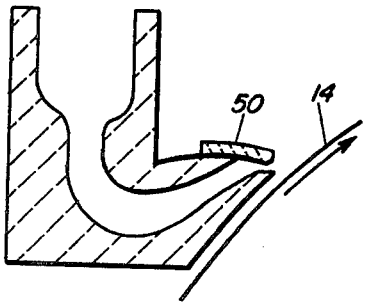
FIG. 5 is a cross-sectional view of an alternative tundish and nozzle of the present invention.
Figure 6:
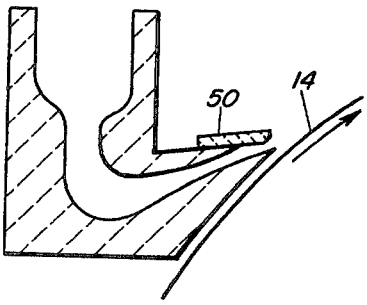
FIG. 6 is a cross-sectional view of an alternative tundish and nozzle of the present invention.
Figure 7:
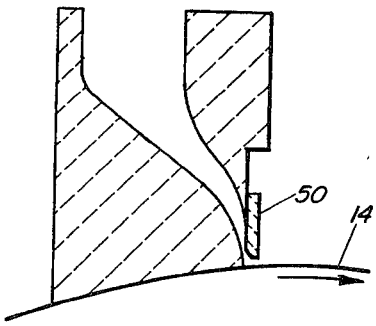
FIG. 7 is a cross-sectional view of an alternative tundish and nozzle of the present invention.
Figure 12:
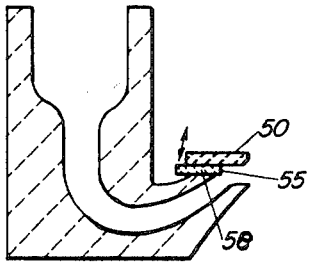
FIG. 12 is a cross-sectional view of an alternative tundish and nozzle of the present invention.

Preferably, the insert 50 is reciprocal on the ridge 52 of the tundish 22 in a direction toward and away from the casting surface 14. Such reciprocal disposition of the insert 50 may be obtained by manual adjustment, but preferably the insert 50 should be automatically adjustable and continuously measurable to insure that desired spacings, gaps and the like are maintained during casting. In a preferred embodiment, as shown in FIG. 2, the insert 50 is reciprocal in a generally horizontal plane. However, it should be understood that the insert 50 may be reciprocal along an angular path, as shown in FIGS. 4 and 6, along an arcuate path as shown in FIG. 5, or in a generally vertical plane as shown in FIG. 7. In another embodiment, as illustrated in FIG. 12, the insert 50 may be disposed on an element 55 which element 55 may be adjusted to any number of positions by rotating thereof about a pivot point 58 to obtain the desired disposition of the insert 50.

Figure 8:
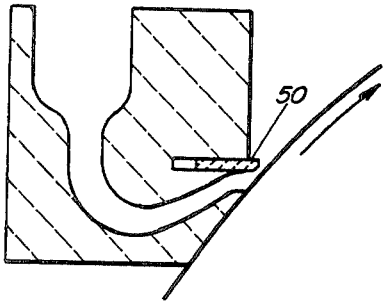
FIG. 8 is a cross-sectional view of an alternative tundish and nozzle of the present invention.

Although the insert 50 may be reciprocal toward and away from the casting surface 14, the insert 50 must not be permitted to lift from its fixed position against the ridge 52 of the tundish 22. This fixed position is necessary to counteract the pressure which the molten metal may exhibit against the inside surface 48 of the insert 50. In one embodiment, a weight may be placed on a top surface 56 of the insert 50. In another embodiment, a pressure exerting device such as a spring biased device, a hydraulic cylinder arrangement, a clamp or the like, may be used to urge the insert against the ridge 52 of the tundish 22. In a further embodiment, as illustrated in FIG. 8, the insert 50 may be held in a slot which provides such required fixed support for the insert 50. Note that even with the arrangement illustrated in FIG. 8, the insert 50 is still reciprocal toward and from the casting surface.

Figure 13:
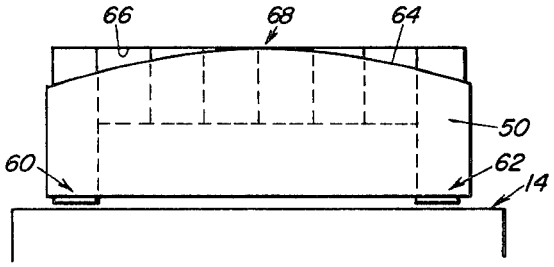
FIG. 13 is a top elevation view of an insert on a tundish of the present invention.

In addition to being reciprocal toward and from the casting surface 14, the insert 50 may be able to be canted such that one end portion 60 of the insert 50 may be moved toward the respective end portion of the casting surface 14 while the other end portion 62 is moved away from the other respective end portion of the casting surface 14, as shown in FIG. 13. An insert structure which may be utilized to facilitate such canting, as shown in FIG. 13, includes an arcuate rear surface 64 for the insert 50, a portion of which abuts a rearward wall 66 to the tundish 22 at a pivot point 68. By rolling the rear surface 64 of the insert 50, minor canting alignments can be effectuated. Regardless of the means employed to cant the insert 50 with respect to the casting surface 14, such canting variations may be helpful to assure that uniform gage strip material is produced, especially during prolonged casting operations. Such canting variations may also assist in removing entrapped material from the nozzle during casting, or for intentionally casting strip material having a varying gage across the width of the strip material.

It should be appreciated that the insert 50 of the present invention may be easily replaced, although it is preferred that the inserts 50 and the tundish 22 be reused, either together or separately. It should also be noted that damage to an insert 50 will not render the entire tundish 22 unserviceable. In the event of such insert damage, the insert 50 is merely replaced and the process continues.

Figure 14:
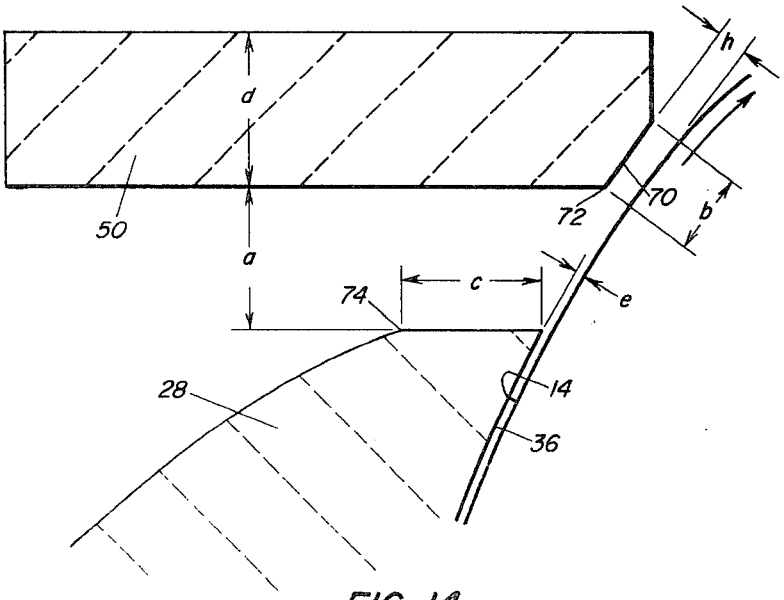
FIG. 14 is an enlarged cross-sectional view of the nozzle area of a tundish of the present invention.

In a preferred embodiment, as shown in enlarged cross-section in FIG. 14, the insert 50 is provided with a front edge surface 70. In such embodiment, as the insert 50 has been reciprocated to its operating position, the front edge surface 70 faces the casting surface 14 and is disposed to within less than 0.120 inch of the casting surface 14. Preferably, the front edge surface 70 is disposed to within 0.080 inch and in a more preferred embodiment, to within 0.020 inch of the casting surface 14. It is also preferred that in such embodiment the front edge surface 70 be in substantially complete parallelism with the casting surface 14 movable therebelow. When utilizing a drum or wheel, and a refractory insert 50, such complete parallelism may be accomplished by placing a sheet of sandpaper, or the like, against the casting surface 14 with the grit side of the sandpaper facing the insert 50. By moving the insert 50 into tight contact with the casting surface 14, with the sandpaper disposed therebetween, and by moving the casting surface and sandpaper simultaneously past the insert 50, the front edge surface 70 is ground by the grit side of the sandpaper into substantially complete parallelism with the casting surface 14. Such substantially complete parallelism may be achieved even when round or other curvilinear casting surfaces are employed. To achieve such parallelism by this procedure 400 or 600 grit sandpaper has been found to be adequate. The outside surface 36 of the rear wall 28 disposed adjacent the casting surface 14 may be brought into substantially complete parallelism therewith by this same procedure.

By maintaining the front edge surface 70 in substantially complete parallelism with the casting surface 14, the standoff distance, or gap h, between the front edge surface 70 and the casting surface 14 is maintained throughout the length thereof. It has been found that the gap h between the front edge surface 70 and the casting surface 14 must be maintained at less than about 0.120 inch in order to successfully cast strip material. Preferably, this gap is maintained at less than about 0.080 inch and for casting certain alloys into thin gage strip, gaps less than 0.020 inch are preferred. Alternatively, the front edge surface 70 of the insert 50 may comprise a line extending across the tundish, at a 90° junction, or corner, of the front edge of the insert 50, as opposed to a defined surface length b as discussed above. To this extent the length b of the front edge surface 70 could be zero. Even if surface 70 approaches a line across the tundish, such surface must be disposed within 0.120 inch of the casting surface 14 to successfully cast strip material.

It has also been found that the gap e between the outside surface 36 of the rear wall 28 and the casting surface 14, as best shown in FIG. 14, does not appear to be as critical. What is preferred with respect to the outside surface 36 of the rear wall 28 is that the surface 36 be disposed as close as possible to the casting surface 14, without causing any interference for the moveable casting surface therebelow. Accordingly, the outside surface 36 of the rear wall 28 at the orifice passage 80 of the nozzle may just clear the casting surface 14, i.e., perhaps within about 0.002 inch, as shown in the drawing. Such spacing must not be large enough to allow significant molten metal backflow therebetween during casting. Alternatively, the outside surface 36 may be tapered from the orifice of the nozzle in a direction away from the casting surface 14.

The crucible 22 is preferably constructed of a material having superior insulating ability. If the insulating ability is not sufficient to retain the molten material at a relatively constant temperature, auxiliary heaters such as induction coils may have to be provided in and/or around the crucible 22, or resistance elements such as wires may be provided. As mentioned above, a convenient material for the crucible is an insulating board made from fiberized koalin, a naturally occurring, high purity, alumina-silica fire clay. Such insulating material is available under the trade name Kaowool HS board. However, for sustained operations, and for casting higher melting temperature alloys, various other materials may have to be employed for constructing the crucible or the insert including graphite, quartz, clay graphite, boron nitride, silicon nitride, boron carbide, silicon carbide, alumina, zirconia and various combinations or mixtures of such materials.

Although other materials are comprehended by the present invention, the insert 50 is preferably constructed of boron nitride, silicon nitride, silicon carbide, boron carbide, zirconia or quartz.

It is imperative that the orifice passage 80 of the nozzle 24 remain open and its configuration remain substantially stable throughout a strip casting operation. It is understandable that the orifice passage 80 should not erode or clog, significantly, during a strip casting sequence or certain objectives such as maintaining uniformity in the casting operation and of minimizing metal flow turbulence in the tundish 22 may be defeated.

Along these lines, it appears that certain insulating materials may not be able to maintain their dimensional stability over long casting periods. To obviate this problem the nozzle 24, especially that portion defined by the insert 50, may be constructed of a material which is better able to maintain dimensional stability and integrity during exposure to high molten metal temperatures for prolonged time periods.

The drive system and housing for the drum, wheel or other casting surface 14 of the present invention should be rigidly constructed to permit drum rotation without structural instability which could cause the drum to slip or vibrate. In particular, care should be taken to avoid resonant frequencies at the operating speeds for the drum. The casting surface should be capable of moving at a surface speed of from about 200 linear surface feet per minute to more that about 10,000 linear surface feet per minute. When utilizing a drum having a circumference of about 8 feet, this rate calculates to a drum speed from about 25 rpm to about 1250 rpm. A three horsepower variable speed reversible, dynamically braked motor provides an adequate drive system for an integral copper casting drum 2 to 10 inches thick and about 8 feet in circumference. Power requirements may have to be modified depending upon the type and size of casting surface 14 employed. It should be appreciated that the casting surface 14 can be moved in a direction opposite to that illustrated in the drawing, and that the tundish 22 may be disposed at any location about the casting wheel illustrated in the drawing.

In one embodiment, the casting surface 14 on the wheel or drum of the apparatus of the present invention is smooth. It has been found that in certain applications for producing amorphous materials, finishing the peripheral surface 14 of a casting drum 12 with 400-grit paper and preferably with 600-grit paper may yield improved product uniformity. It is anticipated that an etched surface may yield the best, smooth surface, product uniformity.

A preferred structure for the nozzle 24 of the apparatus of the present invention is shown in enlarged cross-section in FIG. 14. In one embodiment of this apparatus, the dimensions indicated in FIG. 14 have the following preferred limitations.

| dimension | designation | preferred limitation | more preferred limitation |
|---|---|---|---|
| a | nozzle gap | .010–.080 in. | .025 in.–.035 in. |
| b | length of front edge surface | .00–.16 in. | .02–.06 in. |
| h | insert gap | less than .080 in. | .010–.020 in. |
| e | rear wall gap | less than .020 in. | less than .010 in. |

Dimension c, representing the width of the rear wall at the orifice of the nozzle 24 and d representing the width of the insert 50, appear to be arbitrary and do not appear to be significantly critical to the strip casting operation. In fact, it should be appreciated that dimension c could approach zero if the inside surface 34 of the rear wall could be tapered completely through the orifice passage 80.

Molten metal turbulence during strip casting should be minimized, and perhaps avoided by relieving sharp corners of the nozzle in the direction of casting. It will be understood that such rounding may be accomplished by constructing the tundish walls of an eroding material, such as Kaowool HS board, which may provide natural erosion as a result of the strip casting operation. Turbulence may also be minimized by rounding other corners such as corner 72 on the insert 50 and corner 74 on the rear wall 28 at the nozzle as shown in FIG. 14.

In an exemplary operation of the apparatus of the present invention, molten metal is delivered to a heated crucible 22. It is understood that a heater, such as induction coils of resistance wire, may be provided in and above the crucible 22 to maintain relatively constant molten metal temperatures as may be desired. Also heating devices may be employed on or near the insert 50 because of the general accessibility of the insert 50 in the apparatus of the present invention. For example, resistance wires, or heating coils may be provided in a bottom portion of a pressure exerting device located on or near the insert 50. Also, a torch may have its flame directed against the insert 50 during casting. In the operation of the apparatus of this invention metal may be poured directly into a preheated crucible. Such metal preheat temperature and the heating of the tundish 22 and insert 50 should prevent freezing or clogging of the orifice passage or slot 80 during the initial casting operation, and the temperature of the flowing metal should thereafter keep the crucible 22 and the insert 50 at sufficient temperature to insure uninterrupted molten metal flow through the orifice passage 80. In certain applications the nozzle should be externally heated throughout the casting operation. Also, the metal which is fed to the crucible 22 may be superheated to allow a certain degree of temperature loss without adversely affecting metal flow.

Also, a metallostatic head height in the tundish 22 should be maintained at a relatively constant level throughout the casting operation to assure that a relatively constant static head pressure may be maintained at the orifice of the nozzle 24. This may be accomplished by initially pouring the molten metal into the crucible to the desired height and thereafter controlling the rate at which additional molten metal is poured into the crucible to maintain the metallostatic head. It is understandable that the rate at which additional molten metal is fed to the crucible 22 should be in substantial conformity with the rate at which metal flows from the nozzle orifice onto the casting surface 14 in forming strip material. Maintenance of a relatively constant height of metal in the crucible assures that the molten metal flow pressure through the orifice is maintained relatively constant to as not to adversely affect the casting operation or the quality of the strip material. Alternatively, externally applied pressure may be employed to control the pressure at the nozzle.

Figure 9:
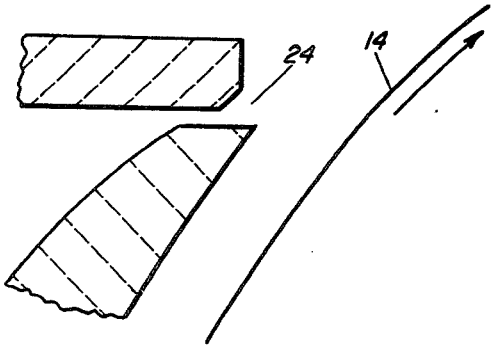
FIGS. 9, 10 and 11 are enlarged cross-sectional views of the nozzle area of a tundish of the present invention illustrating sequentially the disposition of the nozzle with respect to a casting surface.
Figure 10:
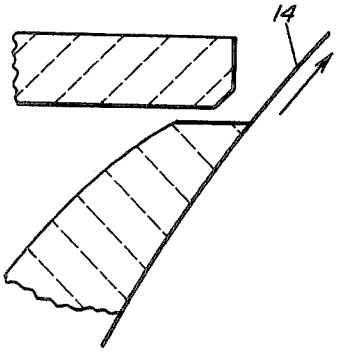

In a preferred embodiment of the present invention, the tundish 22 and the insert 50 are independently or dependently moveable toward and from the casting surface 14. As shown sequentially in FIGS. 9, 10 and 11. The tundish 22 and the insert 50 thereon, are in a position away from the casting surface 14. The casting surface 14 is being moved past the nozzle 24 at a rate of from about 200 to 10,000 linear feet per minute. Prior to or simultaneously with the pouring of molten metal into the tundish, the tundish 22 is moved toward the casting surface 14, such that the outside surface 36 of the rear wall 28 at the nozzle 24 is located to within 0.020 inch, and preferably within 0.010 inch, of the casting surface 14 as shown in FIG. 10. In a preferred embodiment the outside surface 36 is moved as closed as possible to the casting surface 14 without interfering with the motion of the casting surface 14 therebelow.

Figure 11:
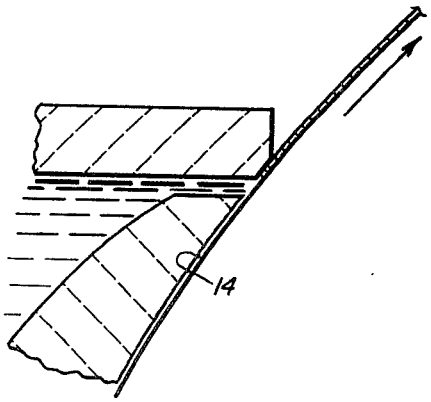

Usually, the insert 50 is not moved from its position relative to the tundish 22, as the tundish 22 is moved toward the casting surface 14. However, either after the outside surface 36 of the rear wall 28 is in position, or while the outside surface 36 is being positioned, the position of the insert 50 should be adjusted such that the front edge surface 70 is within 0.120 inch and more preferably to about 0.010 to 0.020 inch, such as 0.015 inch, of the casting surface 14, as shown in FIG. 11. The tundish 22 and insert 50 should be position soon after casting begins. It will be appreciated that the extent of the gaps h and/or e may be adjusted during casting by the apparatus of the present invention, which provides significant flexibility in the casting operation.

It should be understood that the position of the insert 50 on the tundish 22 may be established, set and maintained before the entire assembly, i.e., tundish 22 including the insert 50, is moved toward its casting position. With such arrangement, the disposition of the insert 50 is properly attained as the disposition of the outside surface 36 of the rear wall 28 is attained. In such embodiment the insert 50 may be fixedly mounted in proper relative position on the tundish 22.

During casting of strip material, the tendency of the strip 10 to adhere to the casting surface 14 for a significant distance, such as several feet or more, beyond the nozzle has been observed. It is understandable that if the strip material remains on a rotating casting drum or wheel 12 for a full revolution damage to the crucible could result. It has been found that the use of a doctor blade, such as a knife type element riding at or near the drum surface 14, approximately 2.5 to 6 feet from the orifice easily counters such adherence. With such an arrangement, the cast strip may be removed from the drum by such doctor blade. Such doctor blade has been found particularly useful in the production of thinner amorphous strip materials which appear to have a greater tendency to adhere to the casting surface 14 than do the crystalline strip materials. It is believed that the force which retains the strip on the casting surface reflects the quality of the thermal contact between the strip and the casting surface. Alternative arrangements, such as an air knife, may also be employed to separate the strip from the wheel.

The casting of relatively high quality strip material including amorphous material, which for the purpose of this invention includes materials which are at least 25% amorphous, is feasible and practical using the apparatus and procedures described above. Understandably, the quench rates must be higher for amorphous material as compared to crystalline material. Quench rates may be accelerated such as by increasing the speed of the casting surface, or the like. It is important to recognize that the process operates in two effective modes. With th orifice quite close to the drum surface, strip perhaps 0.001 to 0.003 inch thick can be cast of either amorphous or crystalline materials. If the front edge surface 70 of the insert 50 is moved away from the casting surface 14, and as casting surface speeds are reduced, strip perhaps 0.005 to 0.050 inch thick can be cast. In this later mode, the quench rate is much lower due primarily to increased product thickness.

The problems associated with flexibility reproducibility and in-process control of strip casting operations, as well as certain problems related to metal turbulence have been overcome by the apparatus of the present invention.

Whereas the preferred embodiment has been described above for the purpose of illustration, it will be apparent to those skilled in the art that numerous variations of the details may be made without departing from the invention.

I claim:

1. An apparatus for continuously casting strip material comprising:

a tundish for receiving and holding molten metal having a nozzle therein through which molten metal is delivered to a casting surface movable past the nozzle at a speed of from 200 to 10,000 linear surface feet per minute, said nozzle comprising a longitudinally extending orifice passage having substantially uniform cross-sectional dimensions throughout a longitudinal extent thereof, defined between a first inside surface and a second inside surface, an insert disposed in the tundish and movable relative to the tundish, said insert forming at least a portion of one of said inside surfaces, and a minimum gap of at least about 0.010 inch is maintained between said inside surfaces, and said insert having a front edge surface thereof above to be disposed to within 0.120 inch of the casting surface.

2. An apparatus as set forth in claim 1 wherein the insert is reciprocal toward and from the casting surface on an outside surface of a front wall of the tundish.

3. An apparatus as set forth in claim 1 wherein the tundish is reciprocal toward and from the casting surface.

4. An apparatus as set forth in claim 1 wherein pressure is exerted against the insert sufficient to overcome the counter pressure of molten metal bearing against the surface of the insert forming an inside surface of the orifice passage.

5. An apparatus as set forth in claim 4 wherein the pressure is provided by a weight on the insert.

6. An apparatus as set forth in claim 4 wherein the pressure is provided by a spring biased device bearing against the insert.

7. An apparatus as set forth in claim 4 wherein the pressure is provided by clamping the insert to the tundish.

8. An apparatus as set forth in claim 1 wherein the insert is reciprocal in a lateral direction.

9. An apparatus as set forth in claim 8 wherein said lateral direction is generally horizontal.

10. An apparatus as set forth in claim 8 wherein said lateral direction is generally vertical.

11. An apparatus as set forth in claim 1 wherein the insert is reciprocal in an angular direction.

12. An apparatus as set forth in claim 1 wherein the insert is reciprocal in an arcuate direction.

13. An apparatus as set forth in claim 1 wherein said front edge surface of the insert has a length less than 0.16 inch.

14. An apparatus as set forth in claim 1 wherein said front edge surface of the insert has a length of from 0.02 to 0.06 inch.

15. An apparatus as set forth in claim 1 wherein the front edge surface of the insert substantially comprises a line across the tundish at a junction of the insert.

16. An apparatus as set forth in claim 1 wherein the front edge surface of the insert is able to be disposed to within 0.080 inch of the casting surface.

17. An apparatus as set forth in claim 1 wherein the front edge surface of the insert is able to be disposed to within 0.020 inch of the casting surface.

18. An apparatus as set forth in claim 1 wherein the front edge surface of the insert is able to be disposed to within 0.015 inch of the casting surface.

19. An apparatus as set forth in claim 1 wherein the front edge surface of the insert is able to be disposed to within 0.010 inch of the casting surface.

20. An apparatus as set forth in claim 13 wherein the front edge surface of the insert is in substantially complete parallelism with the casting surface during casting.

21. An apparatus as set forth in claim 1 wherein the insert is able to be tilted such that the front edge surface may be disposed toward or from the casting surface.

22. An apparatus as set forth in claim 1 wherein the insert may be canted such that end portions of the insert may be moved toward and from the casting surface, respectively.

23. An apparatus as set forth in claim 1 wherein said tundish comprises a front wall and a rear wall with respect to the casting direction, with each wall having inside and outside surfaces with respect to the molten metal holding portion of the tundish, and sidewalls enclosing the front and rear walls of the tundish wherein at least a portion of the outside surface of the rear wall, adjacent the orifice passage is able to be disposed to within at least 0.020 inch of the casting surface.

24. An apparatus as set forth in claim 23 wherein at least a portion of the outside surface of the rear wall, adjacent the orifice passage is able to be disposed to within at least 0.010 inch of the casting surface.

25. An apparatus as set forth in claim 1 wherein at least a portion of each inside surface forms part of an insert disposed in the tundish.

26. An apparatus as set forth in claim 1 wherein the tundish is constructed of a material selected from the group consisting of graphite, alumina graphite, clay graphite, quartz, fiberized kaolin, boron nitride, silicon nitride, silicon carbide, boron carbide, alumina, zirconia, stabilized zirconia silicate, magnesia and combinations thereof.

27. An apparatus as set forth in claim 1 wherein the insert is constructed of a material selected from the group consisting of boron nitride, silicon nitride, boron carbide, silicon nitride, silicon carbide, zirconia, quartz and combinations thereof.

28. An apparatus for continuously casting strip material comprising:

a tundish for receiving and holding molten metal, having a front wall and a rear wall with respect to the casting direction with each wall having inside and outside surfaces with respect to the molten metal holding portion of the tundish, said inside surfaces extending toward and forming an orifice passage through a nozzle through which molten metal is delivered to a casting surface movable past the nozzle at a speed of from 200 to 10,000 linear surface feet per minute, and sidewalls enclosing the front and rear walls of the tundish, an insert disposed against a portion of the outside surface of the front wall a segment of which forms at least a portion of the inside surface of the front wall, said insert movable relative to the tundish and extending beyond the front wall in the direction of the casting surface maintaining a minimum gap of at least 0.010 inch at the orifice passage defined between the inside surface of the rear wall and the insert, said insert having a front edge surface thereof able to be disposed to within 0.120 inch of the casting surface, with at least a portion of the outside surface of the rear wall adjacent the orifice passage of the nozzle able to be disposed to within at least 0.020 inch of the casting surface.

29. A method for continuously casting strip material comprising:

providing a continuous surface upon which metal strip is cast from a molten metal holding tundish having a nozzle, the surface being cooled to solidify the metal and moving past the nozzle at a rate of from about 200 to about 10,000 feet per minute;

the nozzle having an orifice passage defined between first and second inside surfaces and an insert forming at least a portion of one of the inside surfaces;

moving the insert relative to the tundish to adjust the position of the insert to less than about 0.120 inch from the casting surface;

continuously delivering molten metal through the nozzle onto the moving continuous casting surface to form a continuous metal strip; and continuously removing the cast strip from the continuous casting surface.

30. The method as set forth in claim 29 including moving the insert relative to the tundish before the tundish is moved in position toward the casting surface.

31. The method as set forth in claim 29 including moving the insert relative to the tundish after the tundish is moved in position toward the casting surface.

32. The method as set forth in claim 29 including moving the insert relative to the tundish while the tundish is moved in position toward the casting surface.

33. The method as set forth in claim 29 includes moving the insert in a reciprocal lateral direction.

34. The method as set forth in claim 29 includes moving the insert in a generally horizontal lateral direction.

35. The method as set forth in claim 29 includes moving the insert in a generally vertical lateral direction.

36. The method as set forth in claim 29 includes moving the insert in a reciprocal angular direction.

37. The method as set forth in claim 29 includes moving the insert in a reciprocal arcuate direction.

38. A method as set forth in claim 29 includes canting the insert such that end portions of the insert may be moved toward and from the casting surface.

39. A method as set forth in claim 29 includes moving a separate insert forming at least a portion of another inside surface, the movement being relative to the tundish.

* * * * *

UNITED STATES PATENT AND TRADEMARK OFFICE

CERTIFICATE OF CORRECTION

PATENT NO. : 4,484,614

DATED : November 27, 1984

INVENTOR(S) : Robert E. Maringer

It is certified that error appears in the above-identified patent and that said Letters Patent is hereby corrected as shown below:

On the title page, Item (73) should read:
--(73) Assignee: Battelle Development Corporation, Columbus, Ohio--.

Signed and Sealed this

*Tenth* Day of *September 1985*

[SEAL]

*Attest:*

DONALD J. QUIGG

*Attesting Officer* *Acting Commissioner of Patents and Trademarks - Designate*